US005240809A

United States Patent [19]

Prementine et al.

[11] Patent Number: 5,240,809

[45] Date of Patent: Aug. 31, 1993

[54] IMAGEABLE ARTICLES HAVING DYE SELECTIVE INTERLAYERS

[75] Inventors: Glenn S. Prementine, White Bear Lake; Takuzo Ishida, Woodbury, both of Minn.

[73] Assignee: Minnesota Mining and Manufacturing Company, St. Paul, Minn.

[21] Appl. No.: 870,916

[22] Filed: Apr. 20, 1992

[51] Int. Cl.[5] ..... G03C 5/54

[52] U.S. Cl. ..... 430/203; 430/214; 430/215

[58] Field of Search ..... 430/201, 203, 214, 215

[56] References Cited

U.S. PATENT DOCUMENTS

| | | | |
|---|---|---|---|
| 2,761,791 | 9/1956 | Russell | 117/34 |
| 3,330,663 | 7/1967 | Weyde et al. | 96/94 |
| 3,442,224 | 12/1966 | Rutkoski | 105/368 |
| 3,634,089 | 1/1972 | Hamb | 96/87 |
| 3,700,458 | 10/1972 | Lindholm | 96/114.1 |
| 3,785,830 | 1/1974 | Sullivan et al. | 96/114.1 |
| 4,021,240 | 5/1977 | Cerquone et al. | 96/29 |
| 4,021,250 | 5/1977 | Sashihara et al. | 96/114.1 |
| 4,022,617 | 5/1977 | McGuckin | 96/29 |
| 4,123,274 | 10/1978 | Knight et al. | 96/66 |
| 4,220,709 | 9/1980 | deMauriac | 430/353 |
| 4,368,247 | 1/1983 | Fletcher, Jr. et al. | 430/17 |
| 4,374,921 | 2/1983 | Frenchik | 430/338 |
| 4,452,883 | 6/1984 | Frenchik et al. | 430/502 |
| 4,460,681 | 7/1984 | Frenchik | 430/502 |
| 4,476,220 | 10/1984 | Penfound | 430/569 |
| 4,478,927 | 10/1984 | Naito et al. | 430/203 |
| 4,594,307 | 6/1986 | Ishida | 430/203 |
| 4,704,344 | 11/1987 | Aono et al. | 430/203 |
| 4,780,010 | 10/1988 | Behrens et al. | 400/208 |
| 4,883,747 | 11/1989 | Grieve et al. | 430/542 |
| 4,923,792 | 5/1990 | Grieve et al. | 430/559 |
| 5,077,178 | 12/1991 | Herbert et al. | 430/340 |

FOREIGN PATENT DOCUMENTS

| | | |
|---|---|---|
| 1243536 | 10/1988 | Canada . |
| 59-165054 | 9/1984 | Japan . |
| 59-168439 | 9/1984 | Japan . |
| 837095 | 11/1958 | United Kingdom . |

OTHER PUBLICATIONS

Copending U.S. application Docket No. 48192USA3A, "Imageable articles having dye selective interlayers", (Prementine et al.) filed Jun. 4, 1992.

Copending U.S. application Ser. No. 07/775,193, "Photothermographic article for preparing multicolor images", (Ishida et al.) filed Oct. 11, 1991.

M. Sekiya et al., *Chem. Pharm. Bulletin,* 1972, 20(2), 343; Ibid 1974, 22(2), 448.

T. Sohda et al., *Chem. Pharm. Bull.,* 1983, 31(2), 560–5.

"Polymer Handbook", 2nd Edition (edited by J. Brandrup and E. H. Immergut, published by John Wiley and Sons, Inc.

Copending U.S. application Ser. No. 07/871,005, "Imageable articles having dye selective interlayers" (Prementine et al.) filed Apr. 20, 1992.

T. H. James in *The Theory of the Photographic Process,* Fourth Ed.; MacMillan, New York, 1977; pp. 149–169, 374.

*Research Disclosures* No. 17029, Jun. 1978, pp. 9–15.

*The Colour Index;* The Society of Dyes and Colourists: Yorkshire, England, 1971; vol. 4, p. 4437.

K. Venkataraman in *The Chemistry of Synthetic Dyes;* Academic Press: New York, 1952; vol. 2, p. 1206.

F. M. Hamer in *The Cyanine Dyes and Related Compounds;* Interscience Publishers: New York, 1964; p. 492.

F. X. Smith et al., *Tetrahedron Lett.,* 1983, 24(45), 4951–4954.

X. Huang and L. Xe, *Synthetic Communications,* 1986, 16(13), 1701–1707.

H. Zimmer et al., *Journal of Organic Chemistry,* 1960, 25, 1234–5.

*Primary Examiner*—Richard L. Schilling

*Attorney, Agent, or Firm*—Gary L. Griswold; Walter N. Kirn; Gregory A. Evearitt

[57] ABSTRACT

The use of copolymers of vinylidene chloride and vinyl pyrrolidone as selective diffusion media in dye-diffusive photothermographic imaging constructions is disclosed. Unoxidized phenolic leuco dye molecules diffuse into a film of these copolyers but do not readily diffuse out. In contrast, their oxidized dye forms, which are quinoidal in nature, readily diffuse through these interlayers resulting in improved image stability and color separation.

14 Claims, No Drawings

IMAGEABLE ARTICLES HAVING DYE SELECTIVE INTERLAYERS

FIELD OF THE INVENTION

This invention relates to photothermographic materials and in particular it relates to dry silver systems capable of producing color images.

BACKGROUND OF THE ART

Imaging systems capable of producing multiple colors often rely upon barrier interlayers to separate adjacent imaging chemistries. In some cases, such as those in which a dye image is formed and diffused to a receiving layer, the interlayer must not only separate imaging chemistries, but be permeable to dyes as well. Dry silver based imageable articles are one type of imaging system which may employ interlayers in this manner.

Dry silver compositions or emulsions are photothermographic compositions and contain a light-insensitive, reducible silver source; a light-sensitive silver source; and a reducing agent for the light-insensitive, reducible silver source. The light-sensitive material is generally photographic silver halide, which must be in catalytic proximity to the light-insensitive, reducible silver source. Catalytic proximity requires an intimate physical association of these two materials so that when silver specks or nuclei are generated by the irradiation or light exposure of the photographic silver halide, those nuclei are able to catalyze the reduction of the reducible silver source by the reducing agent. It has been long understood that silver halide is a catalyst for the reduction of silver ions and the silver-generating, light-sensitive silver halide catalyst progenitor may be placed into catalytic proximity with the light-insensitive, reducible silver source in a number of different fashions, such as by partial metathesis of the light-insensitive reducible silver source with a halogen-containing source; coprecipitation of silver halide and the light-insensitive, reducible silver source material; and other methods that intimately associate the silver halide and the light-insensitive, reducible silver source.

In both photographic and photothermographic emulsions, exposure of the photographic silver halide to light produces small clusters of silver atoms. The image-wise distribution of these clusters is known in the art as a latent image. Since this latent image generally is not visible by ordinary means, the light-sensitive article must be further processed in order to produce a visual image. The visual image is produced by the catalytic reduction of silver ions which are in catalytic proximity to the silver halide grains bearing the latent image.

In color dry silver imaging systems, a leuco dye is typically incorporated as a reducing agent for the light-insensitive, reducible silver source, generally in combination with a spectral sensitizer for the silver halide. The leuco dye is oxidized upon development, thereby giving a colored image. In full color constructions, spectrally sensitized emulsion layers are typically coated onto a substrate and separated by one or more barrier interlayers.

Residual silver stain is a major problem with dry silver color constructions known in the art. This has been overcome by causing the developed dye image to diffuse from the dry silver layer to an image-receiving layer that is then stripped from the emulsion layer(s). In this case, a barrier interlayer must serve the dual roles of separating the chemistry of neighboring emulsion layers while allowing diffusion of the dye image under thermal processing conditions. In addition to the dye image, other components of the emulsion layers also diffuse to the image-receiving layer under thermal processing conditions. In this regard, unoxidized leuco dyes from the emulsion layers tend to diffuse to the image-receiving layer where they oxidize over time leading to poor print stability and color separation. Therefore, there is a need for interlayers which allow dye images, but not neutral leuco dyes, to diffuse to the image-receiving layer. Depending on the particular ingredients of a given dry silver layer, the development may be best carried out, for example, under acidic or basic conditions.

When multiple dry silver layers with incompatible developing chemistries are employed, it is very difficult to keep development conditions within the dry silver layer from affecting the development of nearby or adjacent dry silver layers. As a result, it is advantageous to coat dry silver layers with different developing conditions on opposite sides of a transparent substrate.

U.S. Pat. No. 4,594,307 discloses a heat developable photographic material that produces a pure and stable dye image by the oxidation reduction reaction between a reducible, light-insensitive organic silver salt and a leuco dye reducing agent wherein the dye formed is transferred to an image-receiving layer by continuing the heating for development in order to separate the dye formed from the silver images and other residual chemicals.

The generation of color dry silver images has been accomplished using microencapsulated constructions and tri-pack (yellow/magenta/cyan) multilayer constructions, such as those disclosed in U.S. Pat. Nos. 4,883,747 and 4,923,792. These patents disclose the use of Gantrez TM S-97 polystyrene; Vinol TM 523 partially hydrolyzed polyvinyl acetate; and Butvar TM B-76 polyvinyl butyral as barrier interlayers. These constructions generally have substantial silver and sensitizer stain present that affects the image color separation. The stain problem can be overcome by causing the developed dye image to diffuse from the image-forming layers into a receptor layer that is subsequently stripped from the rest of the construction. The success of this type of approach depends in large part on the barrier interlayers between the image-forming layers of the tri-pack construction selectively permitting migration of the image-forming dyes while controlling the migration of other image-forming layer components, particularly neutral leuco dyes.

U.S. Pat. Nos. 4,021,240; 4,460,681; and 5,077,178 disclose the use of multiple image-forming layers separated by barrier or interlayers.

U.S. Pat. No. 4,452,883 discloses photothermographic elements with barrier interlayers comprised of polyvinyl pyrrolidone and a methyl vinyl ether/maleic anhydride copolymer. It was taught that the maleic anhydride in the copolymer was gradually hydrolyzed over time to maleic acid, which then crosslinked with the polyvinyl pyrrolidone.

U.S. Pat. No. 4,374,921 discloses color photothermographic articles in which the various color-forming layers are separated by organic solvent soluble barrier layers that are insoluble in the organic solvent used to coat at least one of the adjacent color-forming layers. The barrier polymer disclosed therein is a copolymer of the ethyl monoester of poly(methyl vinyl ether/maleic acid) (Gantrez ES-225 TM, GAF Corp.). GAF Technical Bulletin 9642-070 (1967) at page 12 discloses that poly(N-vinylpyrrolidone) (i.e., PAP) crosslinks with polyacids such as polyacrylic acid or with Gantrez ES-225 TM to form complexes that are insoluble in water but dissolve in dilute alkali.

U.S. Pat. No. 4,704,344 discloses the use of hydrophilic poly(N-vinyl pyrrolidone) blends and copolymers as dye receiving layers for dry silver dye diffusion systems.

SUMMARY OF THE INVENTION

In accordance with the present invention, it has been discovered that vinyl pyrrolidone-vinylidene chloride copolymers are useful as interlayers in dye diffusive imageable articles employing phenolic leuco dyes which are oxidozable quinoidal dyes and have the ability to selectively hinder the diffusion of phenolic leuco dyes while permitting the diffusion of oxidized, quinoidal dyes.

In one embodiment, the present invention provides imageable articles comprising: (a) an image-forming layer comprising a phenolic leuco dye which generates a quinoidal dye upon oxidation; (b) an image-receiving layer; and (c) a polymeric interlayer interposed between the image-forming and image-receiving layers, the polymeric interlayer comprising a vinyl pyrrolidone-vinylidene chloride copolymer.

In another embodiment, the present invention provides imageable articles comprising a suitable substrate coated on one side thereof with an image-receiving layer, the image receiving layer having coated thereon a plurality of image-forming layers separated by polymeric interlayers, at least one of the polymeric interlayers comprising a vinyl pyrrolidone-vinylidene chloride copolymer.

In still another embodiment, the present invention provides a method of purifying a mixture comprising a phenolic leuco dye and a quinoidal dye, the method comprising heating the mixture comprising a phenolic leuco dye and a quinoidal dye while in intimate contact with a layer comprising a vinyl pyrrolidone-vinylidene chloride copolymer, thereby causing the quinoidal dye to preferentially diffuse through the layer.

By the phrase "intimate contact", it is meant that the mixture containing the phenolic leuco and quinoidal dyes must be in direct contact with the layer, typically an interlayer, comprising the vinyl pyrrolidone-vinylidene chloride copolymer. For example, the dye-containing mixture may be overcoated with the polymeric layer. In another possible arrangement, the dye-containing mixture is applied to one substrate and the polymeric layer is applied to another substrate and then the two structures are laminated together such that the dye-containing mixture and the polymeric layer are in direct contact with one another.

DETAILED DESCRIPTION OF THE INVENTION

The present invention provides imageable articles (having improved image stability) which comprise: (a) an image-forming layer comprising a phenolic leuco dye which generates a quinoidal dye upon oxidization; (b) an image-receiving layer; and (c) a polymeric interlayer interposed between the image-forming and image-receiving layers, the polymeric interlayer comprising a vinyl pyrrolidone-vinylidene chloride copolymer. In a preferred embodiment, the polymeric interlayer is immediately adjacent to the image-forming layer.

While single color applications are envisioned, the greatest benefit of the present invention may be obtained in multicolor or full color applications. These typically comprise a substrate coated having a dye receiving layer coated thereon, the dye receiving layer having coated thereon a plurality of imaging layers separated by polymeric interlayers. At least one of the interlayers comprises a copolymer of vinyl pyrrolidone and vinylidene chloride.

Alternatively, the image-receiving layer may be supplied as an external component carried on a second substrate that is brought into contact (i.e., laminated) with a first substrate bearing an image-forming layer during processing such that the dye image is transferred from the first substrate to the image-receiving layer. In that case, the laminated construction constitutes an imaged construction according to the present invention.

Image-Forming Layer

The image forming layer may be of any type known in the imaging art in which a colored dye image is formed by oxidation of a neutral phenolic leuco dye to form a quinoidal dye.

In a preferred embodiment, the image-forming layer(s) comprise(s) a dry silver composition which comprises an intimate mixture of a light-sensitive silver halide; a light-insensitive, reducible silver source such as a silver salt of an organic acid (e.g., silver behenate; silver benzimidazolate; or silver saccharine); neutral phenolic leuco dye; and an auxiliary reducing agent. As used herein the phrase "auxiliary reducing agent" refers to an additional reducing agent (e.g., phenol, hindered phenol, methyl gallate, catechol, pyrogallol, hydroquinone, etc.) for the light-insensitive, reducible source of silver in addition to the leuco dye which also functions as a reducing agent for silver ion. Normally, dry silver compositions further comprise a spectral sensitizer. Such a mixture is usually prepared in a solvent as a dispersion that is spread as a layer on a suitable substrate. When dry, the layer is exposed to a light image and thereafter, a reproduction of the image is developed by heating the coated substrate.

Imaging layer(s) of the invention may comprise a single coated layer or a plurality of sequentially coated sublayers in which the various components are dispersed. In cases where the imaging layers comprise a plurality of sublayers, the sublayer containing the silver halide is referred to as an emulsion layer.

Silver Halide

Silver halides known in the art for use in photothermography are useful in the present invention and include, but are not limited to, silver chloride, silver chlorobromide, silver chloroiodide, silver bromide, silver iodobromide, silver chloroiodobromide, and silver iodide.

The silver halide used in the present invention may be used as is. However, it may be chemically sensitized with a chemical sensitizing agent such as compounds of sulfur, selenium or tellurium, etc.; compounds of gold, platinum, palladium, rhodium or iridium, etc.; a reducing agent such as tin halide, etc.; or combinations thereof. Details thereof are described in James, T. H. The Theory of the Photographic Process, Fourth Ed.; MacMillan: New York, 1977; pp. 149-169.

The light sensitive silver halide used in the present invention is preferably employed in a range of about 0.01–10 weight percent, and more preferably about 0.1 to 1.0 weight percent, based upon the total weight of each imaging layer in which the silver halide is present.

Sensitizer

The sensitizer employed in the dry silver composition may be any dye known in the photographic art to spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful.

Preferably, about $10^{-10}$ to $10^{-1}$ mole and more preferably, $10^{-8}$ to $10^{-3}$ mole, of sensitizing dye is used per mole of silver halide.

Light-Insensitive Organic Silver Salt

The light-insensitive organic silver salt that can be used in the present invention is a silver salt that is comparatively stable to light and which forms a silver image by reacting with the above described leuco compound or an auxiliary developing agent that is coexisting with the leuco compound, if desired, when it is heated to a temperature of above 80° C., and preferably, above 100° C., in the presence of exposed silver halide. Suitable organic silver salts include silver salts of organic compounds having a carboxyl group. Preferred examples thereof include silver salts of aliphatic and aromatic carboxylic acids. Preferred examples of silver salts of aliphatic carboxylic acids include silver behenate, silver stearate, silver oleate, silver laurate, silver caproate, silver myristate, silver palmitate, silver maleate, silver fumarate, silver tartarate, silver linoleate, silver butyrate and silver camphorate, mixtures thereof, etc. Silver salts that are substituted with a halogen atom or a hydroxyl group can also be effectively used. Preferred examples of silver salts of aromatic carboxylic acids and other carboxyl group-containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenyl benzoate, etc., silver gallate, silver tannate, silver phthalate, silver terephthalate, silver salicylate, silver phenylacetate, silver pyromellitate, silver salts of 3-carboxymethyl-4-methyl-4-thiazoline-2-thiones or the like as described in U.S. Pat. No. 3,785,830; and silver salts of aliphatic carboxylic acids containing a thioether group as described in U.S. Pat. No. 3,330,663, etc. Silver salts of compounds containing mercapto or thione groups and derivatives thereof can be used. Preferred examples of these compounds include silver 3-mercapto-4-phenyl-1,2,4-triazolate, silver 2-mercaptobenzimidazolate, silver 2-mercapto-5-aminothiadiazolate, silver 2-(S-ethylglycolamido)benzothiazolate; silver salts of thioglycolic acids such as silver salts of S-alkyl thioglycolic acids (wherein the alkyl group has from 12 to 22 carbon atoms); silver salts of dithiocarboxylic acids such as silver dithioacetate, silver thioamidoate, silver 1-methyl-2-phenyl-4-thiopyridine-5-carboxylate, silver triazinethiolate, silver 2-sulfidobenzoxazole; and silver salts as described in U.S. Pat. No. 4,123,274. Furthermore, silver salts of a compound containing an amino group can be used. Preferred examples of these compounds include silver salts of benzotriazoles, such as silver benzotriazolate; silver salts of alkyl substituted benzotriazoles such as silver methylbenzotriazolate, etc.; silver salts of a halogen substituted benzotriazoles such as silver 5-chlorobenzotriazolate, etc.; silver salts of carboimidobenzotriazoles, etc.; silver salts of 1,2,4-triazoles and 1-H-tetrazoles as described in U.S. Pat. No. 4,220,709; silver salts of imidazoles; and the like.

The silver halide and the organic silver salt that form a starting point of development should be in reactive association (i.e., in the same layer, in adjacent layers or layers separated from each other by an intermediate layer having a thickness of less than 1 micron). It is preferred that the silver halide and the organic silver salt are present in the same layer.

The silver halide and the organic silver salt that are separately formed in a binder can be mixed before use to prepare a coating solution, but it is also effective to blend both of them in a ball mill for a long time. Further, it is effective to use a process which comprises adding a halogen-containing compound in the organic silver salt prepared to partially convert the silver of the organic silver salt to silver halide.

Methods of preparing these silver halide and organic silver salts and manners of blending them are described in Research Disclosures No. 17029 and U.S. Pat. No. 3,700,458.

The light-insensitive, reducible source of silver is preferably present in an amount of from 0.1 to 50 weight percent, and more preferably 1–5 weight percent, based upon the total weight of each imaging layer(s) in which the silver source is present.

A suitable coating amount of the light-sensitive silver halide and the organic silver salt employed in the present invention is in a total from 50 mg to 10 g/m$^2$ calculated as an amount of silver as disclosed, for example, in U.S. Pat. No. 4,478,927.

Leuco Dye

Suitable leuco dyes for use in the present invention are compounds which oxidize to form a quinoidal dye image. In practice of the present invention, at least one imaging layer must comprise a phenolic leuco dye such as 2-(3,5-di-t-butyl-4-hydroxyphenyl)-4,5-3-diphenylimidazole, or bis(3,5-di-t-butyl-4-hydroxyphenyl)phenylmethane. Some phenolic leuco dyes useful in practice of the present invention are disclosed in U.S. Pat. Nos. 4,374,921; 4,460,681; and 4,780,010 which are incorporated herein by reference. Preferred neutral leuco dyes are phenolic leuco dye such as 2-(3,5-di-t-butyl-4-hydroxyphenyl)-4,5-3-diphenylimidazole, or bis(3,5-di-t-butyl-4-hydroxyphenyl)phenylmethane. Some phenolic leuco dyes useful in practice of the present invention are disclosed in U.S. Pat. Nos. 4,374,921; 4,460,681; 4,594,307; and 4,780,010, which are incorporated herein by reference.

The leuco dyes used in the present invention may be any colorless or lightly colored compound that forms a visible dye upon oxidation. The compound must be oxidizable to a colored state. Compounds that are both pH sensitive and oxidizable to a colored state are useful, but not preferred, while compounds only sensitive to changes in pH are not included within the term "leuco dyes" since they are not oxidizable to a colored form. The dyes formed from the leuco dye in the various color-forming layers should, of course, be different. A difference of at least 60 nm in reflective maximum absorbance is preferred. More preferably, the absorbance maximum of dyes formed will differ by at least 80–100 nm. When three dyes are to be formed, two should differ by at least these minimums, and the third should differ from at least one of the other dyes by at least 150 and more preferably, at least 200 or even at least 250 nm. Any leuco dye capable of being oxidized by silver ion to form a visible dye is useful in the present invention as previously noted. Leuco dyes such as those disclosed in U.S. Pat. Nos. 3,442,224; 4,021,250; 4,022,617 and 4,368,247 are also useful in the present invention.

Other leuco dyes may be used in imaging layers as well, for example benzylidene leuco compounds cited in U.S. Pat. No. 4,923,792, incorporated herein by reference. The reduced form of the dyes must absorb less strongly in the visible region of the electromagnetic spectrum and be oxidized by silver ions back to the original colored form of the dye. Benzylidene dyes have extremely sharp spectral characteristics giving high color purity of low gray level. The dyes have large extinction coefficients typically in the order of $10^4$ to $10^5$ and possess good compatibility and heat stability. The dyes are readily synthesized and the reduced leuco forms of the compounds are very stable.

The dyes generated by the leuco compounds employed in the elements of the present invention are known and are disclosed, for example, in The Colour Index; The Society of Dyes and Colourists: Yorkshire, England, 1971; Vol 4, p 4437; and Venkataraman, K. The Chemistry of Synthetic Dyes; Academic Press: New York, 1952; Vol. 2, p 1206; U.S. Pat. No. 4,478,927, and Hamer, F. M. The Cyanine Dyes and Related Compounds; Interscience Publishers: New York, 1964; p 492.

The leuco compounds may readily be synthesized by techniques known in the art. There are many known methods of synthesis from precursors since the reaction is a simple two step hydrogen reduction. Suitable methods are disclosed, for example, in: F. X. Smith et al. Tetrahedron Lett. 1983, 24(45), 4951–4954; X. Huang. L. Xe, Synth. Commun. 1986, 16(13) 1701–1707; H. Zimmer et al. J. Org. Chem. 1960, 25, 1234–5; M. Sekiya et al. Chem. Pharm. Bull. 1972, 20(2), 343; Ibid 1974, 22(2), 448; and T. Sohda et al. Chem. Pharm. Bull. 1983, 31(2) 560–5.

Further, as other image forming materials, materials where the mobility of the compound having a dye part changes as a result of an oxidation-reduction reaction with silver halide, or an organic silver salt at high temperature can be used, as described in published Japanese Patent Application No. 165,054 (1984). Many of the above described materials are materials wherein an image-wise distribution of mobile dyes corresponding to exposure is formed in the light-sensitive material by heat development. Processes of obtaining visible images by transferring the dyes of the image to a dye fixing material (diffusion transfer) have been described in the above described cited patents and published Japanese Patent Application Nos. 168,439 (1984) and 182,447 (1984).

The total amount of leuco dye utilized in the present invention should preferably be in the range of 1–50 weight percent, and more preferably in the range of 5–20 weight percent, based upon the total weight of each individual layer in which the leuco dye is(are) employed.

When the heat developable light-sensitive material used in this invention is heat developed in a substantially water-free condition after or simultaneously with image-wise exposure, a mobile dye image is obtained simultaneously with the formation of a silver image either in exposed areas or in unexposed areas with exposed light-sensitive silver halide.

The light-sensitive silver halide and the organic silver salt oxidizing agent used in the present invention are generally added to at least one binder(s) as described below. Further, the dye releasing redox compound is dispersed in the binder described below.

The binder(s) that can be used in the present invention can be employed individually or as a combination thereof. The binder may be hydrophilic or hydrophobic. A typical hydrophilic binder is a transparent or translucent hydrophilic colloid, examples of which include a natural substance, for example, a protein such as gelatin, a gelatin derivative, a cellulose derivative, etc., a polysaccharide such as starch, gum arabic, pullulan, dextrin, etc., and a synthetic polymer, for example, a water-soluble polyvinyl compound such as polyvinyl alcohol, polyvinyl pyrrolidone, acrylamide polymer, etc. Another example of a hydrophilic binder is a dispersed vinyl compound in latex form which is used for the purpose of increasing dimensional stability of a photographic material.

Preferably, the polymeric binder is present in an amount in the range from 1–99 weight percent, and more preferably, from 20–80 weight percent in each layer in which the polymeric binder is employed.

The coating amount of the binder used in the present invention is 20 g or less per $m^2$, preferably, 10 g or less per $m^2$, and more preferably, 7 g or less per $m^2$.

The preferred photothermographic silver containing polymer is polyvinyl butyral, but ethyl cellulose, methacrylate copolymers, maleic anhydride ester copolymers, polystyrene, and butadiene-styrene copolymers can be used where applicable according to the solvents used.

In the photographic light-sensitive material and the dye fixing material of the present invention, the photographic emulsion layer and other binder layers may contain inorganic or organic hardeners. It is possible to use chromium salts such as chromium alum, chromium acetate, etc.; aldehydes such as formaldehyde, glyoxal, glutaraldehyde, etc.; N-methylol compounds such as dimethylolurea, methylol dimethylhydantoin, etc.; dioxane derivatives such as 2,3-dihydroxydioxane, etc.; active vinyl compounds such as 1,3,5-triacryloylhexahydro-s-triazine, 1,3-vinylsulfonyl-2-propanol, etc.; active halogen compounds such as 2,4-dichloro-6-hydroxy-s-triazine, etc.; mucohalogenic acids such as mucochloric acid, mucophenoxychloric acid, etc.; which may be used individually or as a combination thereof.

Image-Receiving Layer

Dyes generated during thermal development of light-exposed regions of the emulsion layers migrate under development conditions into a dye receiving layer wherein they are retained. The dye receiving layer may be composed of a polymeric material having affinity for the dyes employed. Necessarily it will vary depending on the ionic or neutral characteristics of the dyes.

Examples of organic polymeric materials used in the dye receiving material of this invention include polystyrene having a molecular weight of 2,000 to 85,000, polystyrene derivatives having substituents with not more than 4 carbon atoms, polyvinyl cyclohexene, polydivinylbenzene, polyvinylpyrrolidine, polyvinylcarbazole, polyallylbenzene, polyvinyl alcohol, polyacetals such as polyvinyl formal and polyvinyl butyral, polyvinyl chloride, chlorinated polyethylene, polytrifluoroethylene, polyacrylonitrile, poly(N,N-dimethylallylamide), polyacrylates having a p-cyanophenyl group, a pentachlorophenyl group or a 2,4-dichlorophenyl group, poly(acryl chloroacrylate), poly(methyl methacrylate), poly(ethyl methacrylate), poly(propyl methacrylate), poly(isopropyl methacrylate), poly(isobutyl methacrylate), poly(tert-butyl methacrylate), poly(cyclohexyl methacrylate), polyethylene glycol dimethacrylate, poly(cyanoethyl methacrylate), polyesters such as polyethylene terephthalate, polysulfone bisphenol A polycarbonate, polycarbonates, polyanhydrides, polyamides and cellulose acetate. The synthetic polymers described in "Polymer Handbook", 2nd edition (edited by J. Brandrup and E. H. Immergut, published by John Wiley and Sons, Inc.) are also useful. These polymeric substances may be used singly, or a plurality of them may be used in the form of a copolymer.

Interlayers

Interlayers employed in the present invention are selected from polymeric materials that are permeable to the dyes used to form the developed image. They are preferably coated from solvents in which the previously coated emulsion layer is not soluble. At least one of the interlayers employed in the present invention must be a poly(N-vinyl pyrrolidone)-poly(vinylidene chloride) copolymer. The polymer may be either block or random; random copolymers are preferred. This provides the means for separating oxidized quinoidal and unoxidized leuco phenolic forms of imaging dyes employed. The mole ratio of vinylidene chloride to vinyl pyrrolidone should be from about 9:1 to 1:2, preferably 4:1 to 1:1, and most preferably 3:1 to 1:1.

These polymers can be used as interlayers in a construction of at least two, and preferably at least three, color photothermographic color recording system. This type of construction with the proper-solvent selection is conducive to the use of simultaneous multiple coating techniques with good color separation and enables the simultaneous thermal development of at least two or at least three individual color forming photothermographic systems having different chemistry, but similar thermal properties.

Preferably, the interlayers employed in the imageable articles of the present invention should be impermeable to the solvent employed in any layers subsequently coated onto it. The test for determining if an interlayer polymer is impermeable to the solvent of the next layer can be simply performed. First, a layer containing a sensitized, halidized silver salt of a fatty carboxylic (for example, 10–32 carbon atoms, and preferably 12–28 carbon atoms) acid and poly(vinyl butyral) polymer is coated onto a suitable substrate. A second coating comprising interlayer polymer is applied after the first coating has dried. The last layer contains the appropriate solvent, a color forming developer, and toner reactant. The dried coatings are given an excessive light exposure and then heated for 60 seconds at 120°–130° C. The test is positive if no color or image is formed.

The imageable elements of the present invention may be optionally overcoated with a protective coating. Suitable materials for the protective coating include, but are not limited to, polymers that are insoluble in aqueous systems, soluble in some organic solvents, and impervious to certain other organic solvents. The "barrier" polymer, which is the fourth layer and preferably contains the color reactants, is normally a methyl methacrylate polymer (preferably a hard polymer with a Tukon hardness of 20 or more), copolymer, or blend with other polymers or copolymers (for example, copolymers with n-butyl acrylate, butyl methacrylate, and other acrylates such as acrylic acid, methacrylic acid, acrylic anhydride, and the like), polystyrene, or a combination of a polyvinyl chloride tripolymer with a butadiene-styrene copolymer. A preferred polymer is a hard methyl methacrylate homopolymer (i.e., having a Tukon hardness greater than 20, for example Acryloid A21 TM with a Tukon hardness of 21–22) blended with soft methyl methacrylate copolymers (i.e., having a Tukon hardness of less than 20, for example Acryloid B-66 TM with a Tukon hardness of less than 18). The barrier layer may be crosslinked also. This would be preferably done by the inclusion of a latent or activatable crosslinking agent. Crosslinking could then be effected after coating.

The theory of this process is essentially the same for a light-sensitive material comprising a negative emulsion and a light-sensitive material comprising a direct positive emulsion and a light-sensitive material to be developed is an exposed area in one and an unexposed area in the other. Accordingly, even when a direct positive emulsion is used, a dye image providing good color reproducibility is obtained in the same way as in the case of a negative emulsion.

Heating in a substantially water-free condition, as used herein, means heating at a temperature of 80° to 250° C. The term "substantially water-free condition" means that the reaction system is in equilibrium with water in the air and water for inducing or promoting the reaction is not particularly or positively supplied from exterior to the element. Such a condition is described at page 374 of "The Theory of the Photographic Process", 4th Edition (T. H. James, published by Macmillan Co.).

The coating solution used in this invention may be prepared by separately forming a silver halide and an organic silver salt oxidizing agent and mixing them before use. It is also effective to mix the two in a ball mill for a long period of time. Another effective method comprises adding a halogen-containing compound to the prepared organic silver salt oxidizing agent and forming silver halide by the reaction of the halogen-containing compound with silver in the organic silver salt oxidizing agent.

The various layers comprising the imageable articles of the present invention may contain surface active agents for various purposes, for example, as coating aids or for prevention of electrical charging, improvement of lubricating properties, emulsification, prevention of adhesion, improvement of photographic properties (for example, acceleration of development providing hard tones or sensitization), etc. For example, it is possible to use nonionic surface active agents such as saponin (steroid), alkylene oxide derivatives (for example, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkyl amines or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxyl group, a sulfo group, a phospho group, a sulfate group, a phosphate group, etc., such as alkylcarboxylic acid salts, alkylsulfonic acid salts, alkylbenzenesulfonic acid salts, alkylnaphthalenesulfonic acid salts, alkyl sulfuric acid esters, alkylphosphoric acid esters, N-acyl-N-alkyltaurines, sulfosuccinic acid esters, sulfoalkyl polyoxyethylene alkyl phenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkyl betaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol type nonionic surface active agents having a repeating unit of ethylene oxide in their molecules are often preferably incorporated into the light-sensitive material. It is particularly preferred that the molecule contains 5 or more of the recurring units of ethylene oxide.

The light-sensitive material used in the present invention may contain, if desired or necessary, various additives known for heat developable light-sensitive materials and may have a layer or layers other than the light-sensitive layer, for example, an antistatic layer, an electrically conductive layer, a protective layer, an intermediate layer, an antihalation layer, a strippable layer, etc.

The imageable articles the present invention are coated on a substrate. Suitable substrates include rigid and flexible substrates; metals (for example, steel and aluminum plates, sheets, and foils); films or plates composed of various film-forming synthetic or high polymers including addition polymers (for example, polyvinylidene chloride, polyvinyl chloride, polyvinyl acetate, polystyrene, polyisobutylene polymers and copolymers), and linear condensation polymers (for example, polyethylene terephthalate, polyhexamethylene adipate, polyhexamethylene adipamide/adipate); nonwoven wood byproduct based substrates such as paper and cardboard; and glass. Substrates may be transparent or opaque.

Especially useful substrates are films of cellulose acetate films such as cellulose triacetate or diacetate, films of polyamides derived from a combination of heptamethylenediamine and terephthalic acid, a combination of fluorenedipropylamine and adipic acid, a combination of hexamethylenediamine and diphenic acid, and a combination of hexamethylenediamine and isophthalic acid, films of polyesters derived from a combination of diethylene glycol and diphenylcarboxylic acid and a combination of bis-p-carboxyphenoxybutane and ethylene glycol, a polyethylene terephthalate film, and a polycarbonate film.

The films may be modified; for example, polyethylene terephthalate films modified by such modifiers as cyclohexane dimethanol, isophthalic acid, methoxypolyethylene glycol or 1,2-dicarbomethoxybenzenesulfonic acid are effective.

The substrate used for the light-sensitive material in the present invention is one that has good dimensional stability at the processing temperature. The polyesters described in U.S. Pat. No. 3,634,089 are preferably used. More preferably, a polyethylene terephthalate film is used.

If necessary, two or more layers may be applied at the same time by the method as described in U.S. Pat. No. 2,761,791 and British Patent No. 837,095.

In the present invention, the latent image obtained after exposure of the heat-sensitive material can be developed by heating the material at a moderately elevated temperature of, for example, about 80° to about 250° C., for about 0.5 second to about 300 seconds. By increasing or decreasing the heating time, the temperature may be higher or lower within the above range. Temperatures in the range of about 110° to about 160° C. are especially useful. Heating may be carried out by said usual heating means such as a hot plate, an iron, a hot roller, a heat generator using carbon or titanium white, or the like.

The imageable articles of the present invention are prepared by coating methods generally known in the art and described in U.S. Pat. Nos. 4,452,883, 2,761,791, and British Patent No. 837,095.

Heating for transfer of the dyes can be effected by using the same heating means as exemplified for the heat development. To increase the quality of the dye image transferred to the dye receiving layer, it is preferred to prevent an increase in fogging by the occurrence of unnecessary development during dye transfer. For this purpose, it is especially effective to include a compound that reacts with the silver halide and/or can have the silver halide adsorbed thereon as a development stopping agent and/or an antifoggant in any one of the layers constituting the dye receiving material. Such a compound is preferably included in the dye receiving layer or a layer provided above the dye receiving layer, such as a protective layer, because it rapidly inhibits excessive development of the light-sensitive layer during transfer of the dye by heating and a sharp and clear dye image can be obtained. Such compounds include, for example, a nitrogen-containing heterocyclic compound, preferably a 5- or 6-membered heterocyclic compound containing a nitrogen atom.

The following non-limiting examples further illustrate the present invention.

EXAMPLES

Materials used in the following examples were obtained from standard commercial suppliers such as Aldrich Chemical Co., Milwaukee, Wis., unless otherwise noted.

The dyes referred to in the following examples have the following structural formulae:

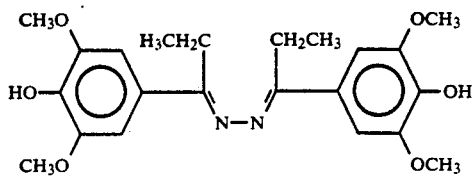

Ethylsyringketazine

-continued

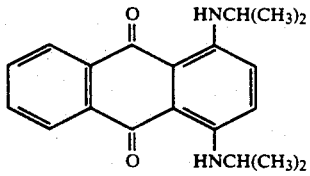

Oil Blue A

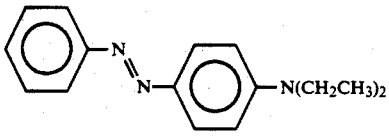

Solvent Yellow 56

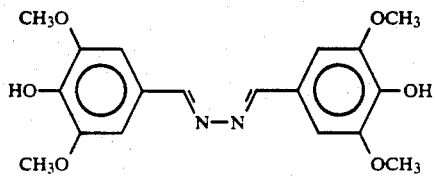

Syringaldazine

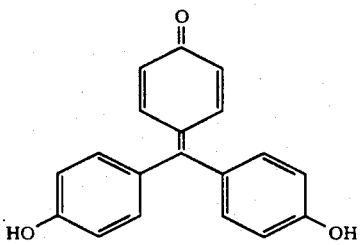

Rosalic Acid

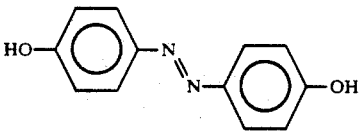

Azophenol

The magenta leuco dye used in Examples 3 and 4 and Comparative examples A and B was isobutylsyringketazine which has the following structural formula:

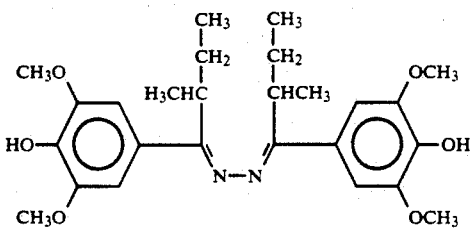

Isobutylsyringketazine

The green sensitizing dye A used in the following examples was prepared according to procedures described in U.S. Pat. No. 4,476,220, and has the following structural formula:

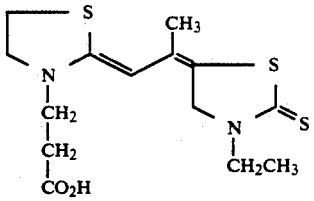

Green Sensitizing Dye A

Example 1

The following is an example of copolymer preparation. Monomers were distilled in a nitrogen atmosphere before copolymerization. A solution of 35 ml vinylidene chloride, 42 ml vinyl pyrrolidone, and 0.1 g azobisisobutyronitrile (corresponding to a molar feed composition of 47% vinyl pyrrolidone) were charged to a 250 ml round bottom flask. The flask was fitted with a septum-capped reflux condenser and placed in a 60° C. oil bath for 45 min in a nitrogen atmosphere. After this time, the reaction mixture was precipitated into methanol. The copolymer was filtered, dissolved in methylene chloride, and reprecipitated into methanol. After a second filtration, the copolymer was dried in vacuo. The yield was 6.5%. The molar composition was determined by microanalysis using the equation: % VP=2.5(64.84%xC). The composition of this particular copolymer was 26–29% vinyl pyrrolidone, accounting for possible analysis error. Based on reactivity ratios of $r_{vp}=0.012$ and $r_{vc}=1.81$, calculated from published Q & e parameters, the expected copolymer composition was 25% vinyl pyrrolidone.

Example 2

This example demonstrates that copolymers of the present invention permit diffusion of quinoidal dyes while selectively restricting the diffusion of phenolic leuco dyes.

Diffusion tests were conducted as follows. The polymers were coated from 7% w/w solutions at 1 mil wet thickness and air dried for 20 min. The topmost layer (the dye donor) contained 0.5% w/w dry concentration of dye. The coatings were then heated to 140° C. on a heat blanket for 30 sec. Absorbance measurements were made both before and after sequential stripping of layers (by repeated application and removal of Scotch brand Magic TM transparent tape) on a MacBeth model TD-402 densitometer. The percent transfer of dye from the donor layer to the underlying layers was calculated as:

$$\%\ Transfer = A(receptor)/A(donor) \times 100\%.$$

The following dyes were used: Solvent Yellow 56, an aromatic azo dye; Oil Blue A, an Anthraquinone dye, Azophenol, Azobenzene, Rosalic Acid, Syringaldazine leuco, Ethylsyringketazine leuco. In the case of the leuco dyes, the layers were sequentially stripped after heating and treated with chloroform solution of N-bromosuccinimide to generate the magenta color.

Table 1 shows that all the dyes tested will diffuse into the vinyl pyrrolidone/vinylidene chloride copolymer, but only those which do not possess two phenolic groups diffuse out. This behavior is confirmed by the last three entries in the table. These two layer experiments show the test copolymer failed to deliver phenolic dye to the receptor after being coated with the dye.

TABLE 1a

| Donor | Barrier | Receptor | Diffusant | % Transfer of Dye to: Barrier[b] | Receptor |
|---|---|---|---|---|---|
| B-76[c] | VP/$VCl_2$[d] | PVC[e] | Rosalic Acid | 31 | 0 |
| " | " | " | Azophenol | 26 | 0 |
| " | " | " | Azobenzene | 20 | 21 |
| " | " | " | SY56[f] | 42 | 28 |
| " | " | " | OBA[g] | 34 | 19 |
| " | " | " | Syringaldazine[h] | 24 | 0 |
| " | " | " | Ethylsyring-ketazine[h] | 26 | 0 |
| B-76 | none | VP/$VCl_2$ | Rosalic Acid | NA | 48 |
| " | " | " | SY56 | NA | 72 |
| VP/$VCl_2$ | " | PVC | SY56 | NA | 63 |
| " | " | " | Rosalic Acid[h] | NA | 0 |
| " | " | " | Syringaldazine[h] | NA | 0 |

[a]Temperature = 140° C., 30 sec dwell time, values are ±4%;
[b]evaluated by subtracting the absorbance of the receptor from the absorbance of the barrier and receptor (after stripping of the donor), and dividing this result by the absorbance of the initial three layers;
[c]Butvar B-76 TM, a polyvinyl butyral available from Monsanto Chemical Co., St. Louis, MO);
[d]25/75 poly(vinyl pyrrolidone-co-vinylidene chloride);
[e]Low molecular weight polyvinyl chloride, purchased from Aldrich Chemical Co.;
[f]Solvent Yellow 56;
[g]Oil Blue A;
[h]leuco developed after diffusion with N-bromosuccinimide; NA means not applicable.

Example 3

This example demonstrates that the copolymers of Examples 4 and 5 decrease the diffusion of phenolic leuco dye while permitting the diffusion of the oxidized form of the dye relative to Comparative Example A.

A 15% solution of a copolymer of vinyl chloride and vinyl acetate (9:1) in methyl ethyl ketone was coated at a wet thickness of 0.08 mm onto an opaque polyester film substrate and dried in an oven at a temperature of 80° C. for five minutes to form an image-receiving layer.

A dispersion of silver behenate half soap (1 mol silver behenate to 1 mol behenic acid, 10% solids) in toluene was made by a homogenization process. A 110 g portion of the 10% half soap dispersion was diluted with 380 g ethanol. Then 0.4 g poly(vinyl butyral) was added to the dilute dispersion and dissolved. Mercuric bromide (10 ml of a solution containing 1.8 g mercuric bromide in 100 ml methanol) was added to the dispersion with stirring. Additional poly(vinyl butyral) (26 g) having a poly(vinyl alcohol) content in the range of 9–13% was added to the dispersion, hereinafter referred to as Dispersion A.

3M Fluorad FC-431 TM (3 drops, a fluorochemical coating additive employed as a stripping agent, 3M Company, St. Paul, Minn.) was added to a 25 g aliquot of Dispersion A and mixed. The resultant dispersion was coated onto the image-receiving layer at a wet thickness of 0.08 mm and dried in an oven at a temperature of 80° C. for 5 min to form a strippable blank emulsion layer.

The following polymer solutions were coated over the blank emulsion layer at a wet thickness of 0.08 mm and dried in an air oven at a temperature of 80° C. for 5 min to form an interlayer:

Comparative Example A: an interlayer coating solution was prepared by dissolving 3.5% of a copolymer of vinylidene chloride and vinyl chloride (1:20, obtained from Scientific Polymer Products, Inc., Ontario, N.Y.) in tetrahydrofuran.

Comparative Example B: an interlayer coating solution was prepared by dissolving 3.5% of polyvinylpyrrolidine (GAF Corp., "PVP K90") in ethanol/methanol/2-propanol (4:5:1, respectively).

Example 4: an interlayer coating solution was prepared by dissolving 3.5% of a copolymer of polyvinyl pyrrolidone and vinylidene chloride (1:9) in dichloromethane.

Example 5: an interlayer coating solution was prepared by dissolving 3.5% of a copolymer of polyvinyl pyrrolidone and vinylidene chloride (2:8) in dichloromethane.

Magenta leuco dye (0.15 g, isobutylsyringketazine) and 0.12 g 1(2H)-phthalazinone were dissolved in a mixture of 2 ml toluene and 6 ml ethanol. The solution was mixed with 1 ml of a solution containing 0.01 g of a green sensitizing dye A in 100 ml methanol, and added to a 25 g aliquot of Dispersion A. The resulting mixed dispersion was coated onto the interlayer at a wet thickness of 0.13 mm and dried in an oven at a temperature of 80° C. for 5 min to form a magenta emulsion layer.

Strips were then cut from the resultant coated sheets and exposed to light in an EG&G sensitometer through a Wratten 58 green filter for $10^{-3}$ sec to produce heat-developable latent images in the emulsion layer. The exposed sheets were heat-developed at a temperature of 138° C. on a heat blanket for 30 sec. The portion of the element containing the photothermographic emulsion layers and the interlayer was then stripped away from the image-receiving layer. Magenta dye images corresponding to the green light exposed area of the sheets were observed to have been transferred to the image-receiving layer. The maximum optical density in the exposed area of each sample was measured with a MacBeth TR924 densitometer with a green filter to determine the diffusion of the oxidized dye form.

Additionally, N-bromosuccinimide solution (0.8 g in 50 ml acetone and 50 ml toluene) was dropped (approximately 0.015 ml) on the nonexposed area of the image-receiving layer. The leuco dye which had been transferred to the image-receiving layer through the emulsion layers and the interlayer was oxidized by the N-bromosuccinimide solution and formed magenta dye.

The treated area was dried at room temperature for 30 min. The optical density of the oxidized dye by the oxidizing agent was measured by the densitometer using a green filter to determine the diffusion of the leuco dye. The results are given in Table 2.

TABLE 2

| Sample | Optical Density of Exposed Area (corresponds to diffusion of oxidized dye) | Optical Density of Non-exposed area (corresponds to diffusion of leuco dye) |
|---|---|---|
| Comparative Example A | 2.04 | 1.56 |
| Comparative Example B | 3.27 | 1.33 |
| Example 3 | 3.06 | 1.43 |
| Example 4 | 2.36 | 1.08 |

The results in the preceding table show that the copolymers of Examples 3 and 4 decrease the diffusion of phenolic leuco dye while permitting the diffusion of the oxidized quinoidal form of the dye relative to Comparative Example A. Comparative Example B has the greatest selectivity in the series, but does not have enough solubility in non-polar organic media for applications in which it is desired. (Other detrimental properties?, adhesion, blister, etc)

Reasonable modifications and variations are possible from the foregoing without departing from either the spirit or scope of the present invention as defined by the claims.

We claim:

1. An imageable article comprising: (a) an image-forming layer comprising a light-insensitive, reducible silver source; a light-sensitive silver halide; a polymeric binder; a sensitizer; and a phenolic leuco dye which generates a quinoidal dye upon oxidation; (b) an image-receiving layer, and (c) a polymeric interlayer interposed between said image-forming and image-receiving layers, said polymeric interlayer comprising a vinyl pyrrolidone-vinylidene chloride copoylmer.

2. The imaging article according to claim 1 wherein said light-insensitive, reducible silver source is a silver salt of an aliphatic carboxylic acid.

3. The imaging article according to claim 2 wherein said light-insensitive, reducible silver source is silver behenate.

4. The imaging article according to claim 1 wherein said light-sensitive silver halide is silver chloride.

5. The imaging article according to claim 1 wherein said imaging layer further comprises toner.

6. The imaging article according to claim 1 wherein the mole ratio of vinylidene chloride to vinyl pyrrolidone in said interlayer is from 9:1 to 1:2.

7. The imaging article according to claim 6 wherein the mole ratio of vinylidene chloride to vinyl pyrrolidone in said interlayer is from 4:1 to 1:1.

8. A dry silver photothermographic element comprising a substrate coated on one side thereof with an image-receiving layer, said image-receiving layer having coated thereon at least one image-forming layer separated from said image receiving layer by a polymeric interlayer, said polymeric interlayer comprising a vinyl pyrrolidone-vinylidene chloride copolymer and said image-forming layer comprising a light-insensitive, reducible silver source; a light-sensitive silver halide; a polymeric binder; a sensitizer; and a phenolic leuco dye that forms a quinoidal dye upon oxidation.

9. The dry silver photothermographic element according to claim 8 wherein said light-insensitive, reducible silver source comprises a silver salt of an aliphatic carboxylic acid.

10. The dry silver photothermographic element according to claim 9 wherein said light-insensitive, reducible silver source comprises silver behenate.

11. The dry silver photothermographic element according to claim 8 wherein said light-sensitive silver halide comprises silver chloride.

12. The dry silver photothermographic element according to claim 8 wherein said imaging layer further comprises toner.

13. The dry silver photothermographic element according to claim 8 wherein the mole ratio of vinylidene chloride to vinyl pyrrolidone in said interlayer is from 9:1 to 1:2.

14. The dry silver photothermographic element according to claim 13 wherein the mole ratio of vinylidene chloride to vinyl pyrrolidone in said interlayer is from about 4:1 to 1:1.

* * * * *